United States Patent [19]

Kaempfe et al.

[11] Patent Number: 4,651,644

[45] Date of Patent: Mar. 24, 1987

[54] DEVICE FOR CLEANING CYLINDERS OF PRINTING MACHINES

[75] Inventors: Joerg Kaempfe; Wolfgang Meurer; Hans Kammel; Otto Nedwig, all of Dresden, German Democratic Rep.

[73] Assignee: Veb Kombinat Polygraph "Werner Lamberz" Leipzig, Leipzig, German Democratic Rep.

[21] Appl. No.: 797,141

[22] Filed: Nov. 4, 1985

[30] Foreign Application Priority Data

Nov. 2, 1984 [DD] German Democratic Rep. ..... 2690305

[51] Int. Cl.[4] ..... B41F 35/02; B41L 41/02

[52] U.S. Cl. ..... 101/423; 101/425

[58] Field of Search ..... 101/423, 424, 425; 118/42, 257

[56] References Cited

U.S. PATENT DOCUMENTS

| | | | |
|---|---|---|---|
| 2,275,063 | 3/1942 | Moore | 118/257 X |
| 2,832,289 | 4/1958 | Mitchell et al. | 101/425 |
| 3,164,087 | 1/1965 | Owen | 101/425 |
| 4,074,627 | 2/1978 | Eck et al. | 101/425 |
| 4,344,361 | 8/1982 | MacPhee et al. | 101/425 |
| 4,554,886 | 11/1985 | Carter | 118/42 |
| 4,555,989 | 12/1985 | Marass et al. | 101/424 |

FOREIGN PATENT DOCUMENTS

| | | |
|---|---|---|
| 2052996 | 10/1970 | Fed. Rep. of Germany . |
| 3005469 | 10/1980 | Fed. Rep. of Germany . |

*Primary Examiner*—Edgar S. Burr
*Assistant Examiner*—James R. McDaniel
*Attorney, Agent, or Firm*—Michael J. Striker

[57] ABSTRACT

A device for cleaning a cylinder of a printing machine by a washing cloth rolled from a supply roll and brought in contact with the surface of the printing cylinder by a pressing arrangement includes two rollers for transporting the washing cloth, a cutting device and a spraying device. The cleaning device is formed as a functional unit removable from and pivotable and lockable in opposite side walls connectable to the printing machine.

4 Claims, 5 Drawing Figures

DEVICE FOR CLEANING CYLINDERS OF PRINTING MACHINES

BACKGROUND OF THE INVENTION

The present invention relates to a cleaning device for cleaning or washing a printing cylinder of a printing machine by means of a washing material rolled from a supply roll and brought into contact with the printing cylinder by a pressure mechanism.

One of the known cleaning devices of the type under discussion has been disclosed in DE-OS No. 3,005,469. The disclosed device includes a supply roll positioned in the side walls thereof, a rolling-up roll and a mechanism for pressing the washing cloth against the cylinder being cleaned. The known device further includes nozzle tubes for water, air and washing liquid. Further the known device has an arrangement for scanning the diameter of the rolling-up roll and a device for controlling a periodical drive so that the same portion of the washing material be continually removed from the supply roll independently from its diameter.

If the washing unit was used up the whole device had to be lifted from the receiving units arranged in the walls of the printing machine and removed from the machine in order to replace the used-up washinging cloth with a new one. Before this operation all the supply conduits for water, air and washing agent had to be separated from the printing machine.

The removal of the cleaning unit from the printing machine has been required not only for exchange of the washing material which is by itself time-consuming and expensive but also for auxiliary and adjusting operations of the machine.

It has been also disadvantageous in conventional cleaning devices of the type under discussion that such a device had a great mass due to a great number of structural components, which could lead, particularly with printing machines of great size, to problems and required at least two persons to install the device into and remove the same from the printing machine. Furthermore, specific connection plugs have been required for coupling and uncoupling supply conduits. The insertion and removal of the device as well as the exchange of the washing material has been time-consuming, which affected the productivity of the printing machine.

A washing device of another type has been disclosed in DT OS No. 2,052,996. This washing device has been designed only for cleaning specific offset printing materials. The supply roll provided in this device supplies a grease-treated cloth which is fed by two periodically driven transporting rollers of the pressing mechanism to a collecting pan. This conventional device, however can be suitable only for special printing machines and is not universal. The machine has also a great mass and requires a great deal of space, which leads to the limitation of an operational space, particularly wih the printing machines employed in aggregates. Finally, the exchange of the grease-treated washing material is complicated, which also affects the efficiency of the printing machine.

SUMMARY OF THE INVENTION

It is an object of the present invention to provide a cleaning device which is easy to handle.

It is another object of the invention to provide a device for cleaning a printing cylinder, in which the number of structural components would be substantially reduced as compared to those of conventional cleaning devices, and in which an exchange of washing cloth would be facilitated.

These and other objects of the invention are attained by a device for cleaning a cylinder of a printing machine with a washing cloth, comprising a supply roll for the washing cloth; pressing means for pressing the washing cloth against the printing cylinder; a transporting roller and a counter pressure roller for pulling the washing cloth from said supply roll to said pressing means; and opposite side walls, said device being a unit further including opposite plates, a scanning device and an elastic hollow member loaded with pressure medium and operating as said pressing means, said plates holding said unit and being pivotable and lockable in said side walls, said unit further including means for cutting a portion of the washing cloth passing the printing cylinder, and means for spraying washing fluid onto the printing cylinder.

The side walls may be pivotable about an axis parallel to the printing cylinder.

The device may further include a washing cloth-receiving container positioned below said cutting means.

Upon the pivoting of the plates, a pressure medium feeding means and said counter pressure roller and said transporting roller are automatically coupled with the washing cloth transported therebetween.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
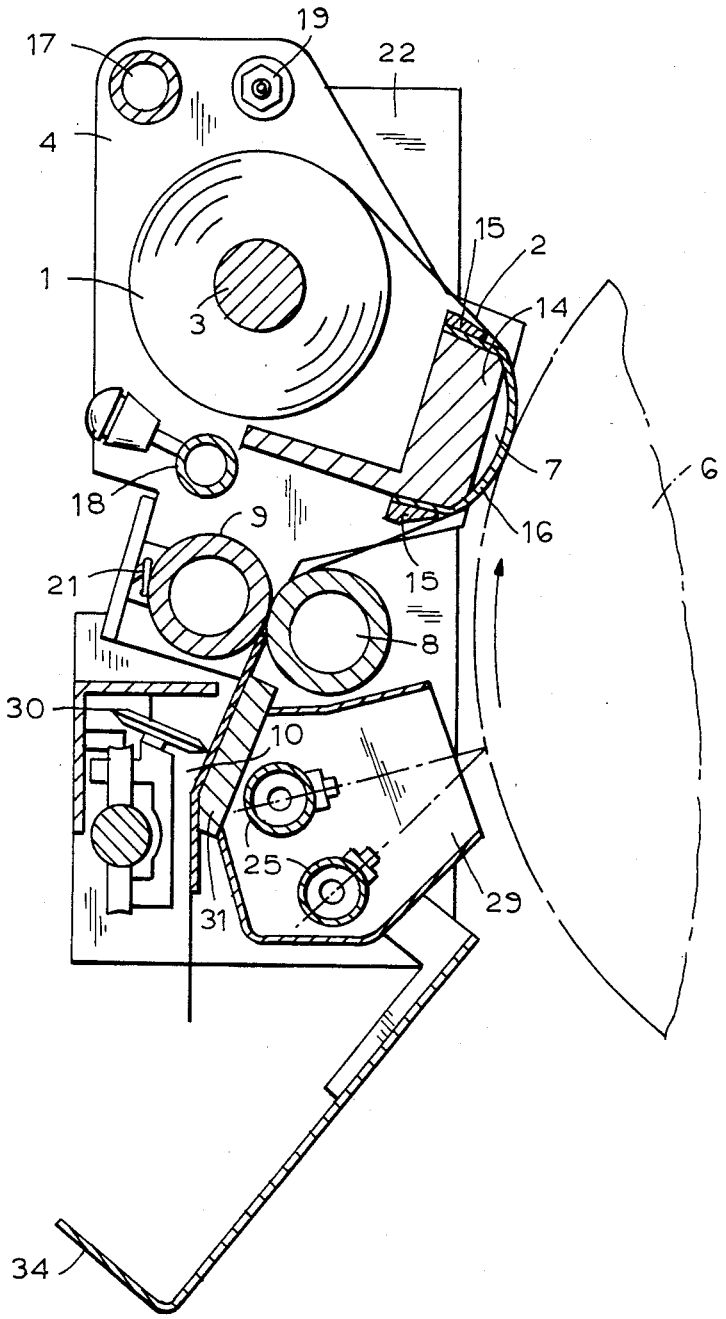
FIG. 1 is a sectional view through a device for cleaning a printing cylinder of a printing machine of the invention.
Figure 4:
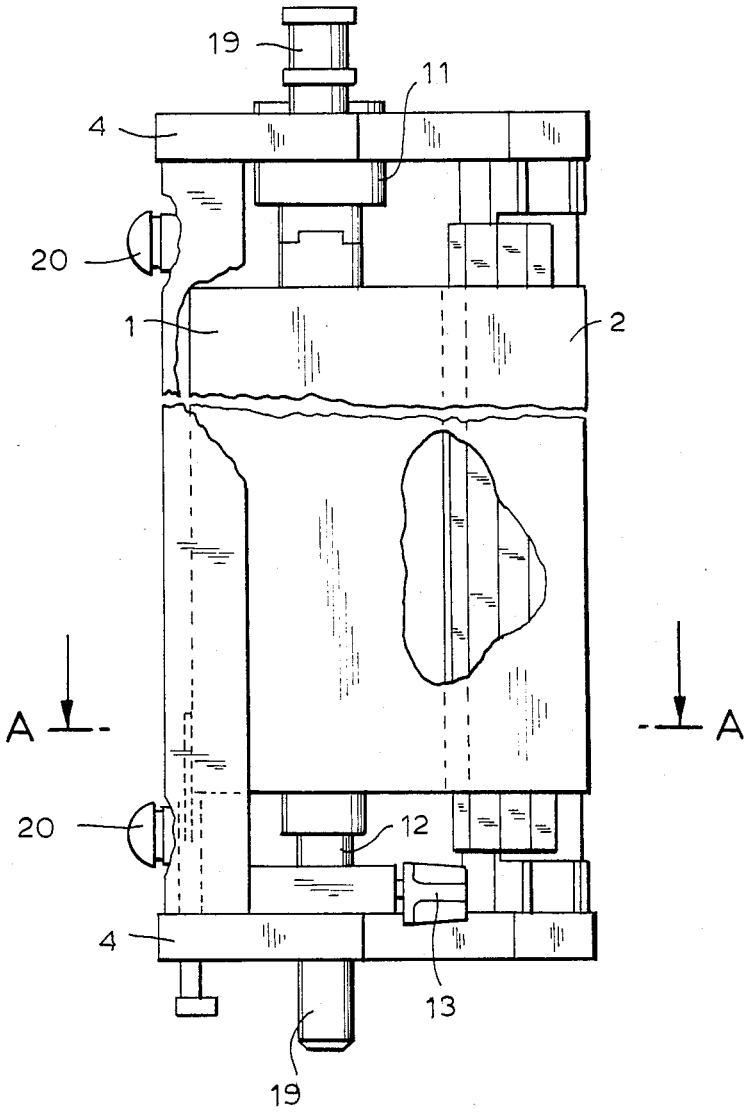
FIG. 4 is a top plan view of the washing unit.

Referring now to the drawings in detail, and firstly to FIG. 1 thereof, it will be seen that a washing material 2 is fed from a supply roll 1 via an elastic hollow member 7 loaded with pressure medium and arranged on a printing cylinder 6 to be cleaned. The washing material is transported by means of a periodically driven transporting roller 8, which cooperates with a counter pressure roller 9, from the hollow member 7 to a cutting device 10. The supply roll is arranged in two opposite plates 4 with the aid of a shaft butt 11 (FIG. 4) which is provided with a brake and a shaft butt 12 in which a locking device 13 is employed. The hollow member 7 which is loaded with pressure medium as mentioned above is positioned between two plates 4. The hollow member 7 is comprised in the exemplified embodiment of a base member 14 and two clamping strips 15 to which an elastic material 16 is secured at the front side of the base member 14 so that escape of the pressure medium from the hollow body or member 7 is impossible.

Figure 5:
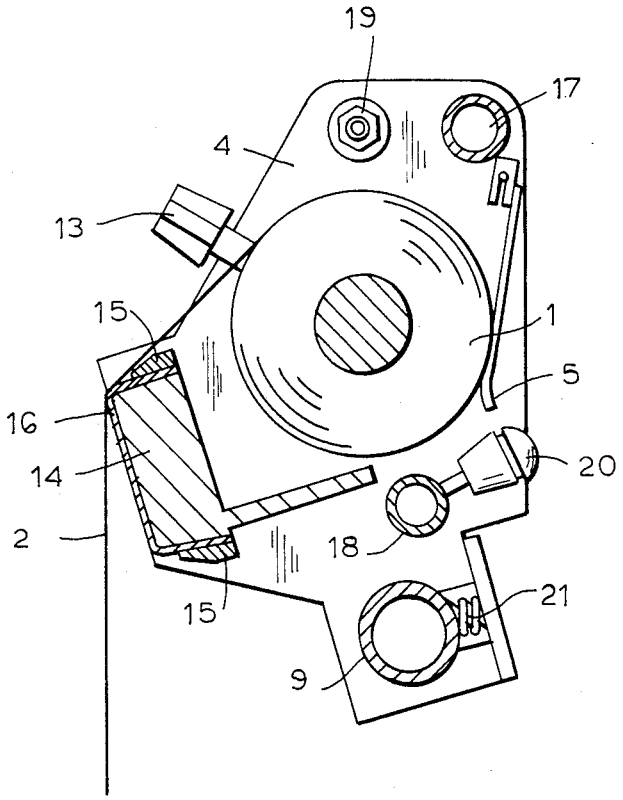
FIG. 5 is a sectional view taken along line A—A of FIG. 4.

As shown in FIG. 5, a scanning device 5 is arranged in plates 4. Furthermore, a bearing pin 19 is also positioned in plates 4. Two opposite plates 4 are held together by means of traverses 17, 18. Traverse 18 is provided at two sides with a locking device which can be actuated by means of a lever 20. The counter pressure roller 9 is positioned in the plates 4 so that it is biased against the transporting roller 8 by a compression spring 21. The function unit which is limited by the plates 4 is identified in the description as a washing unit or washing beam.

Figure 2:
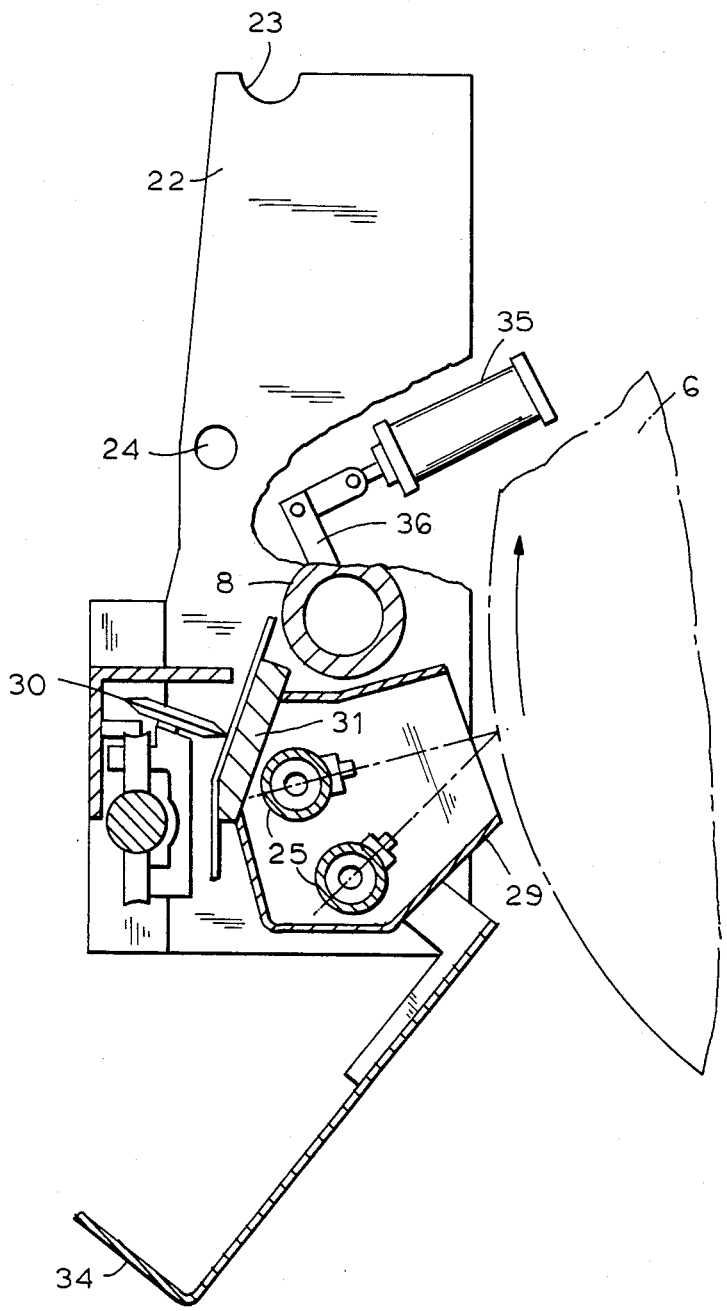
FIG. 2 is a sectional view of the device of the invention without a washing unit.
Figure 3:
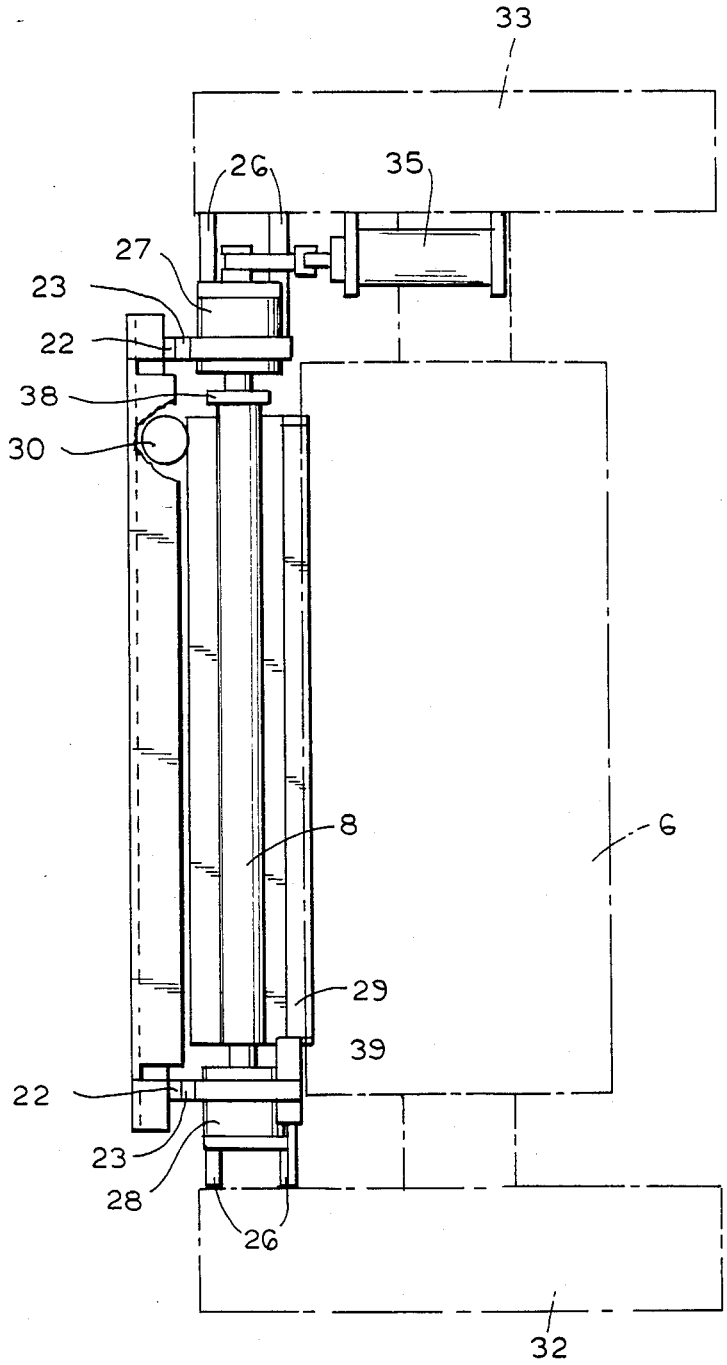
FIG. 3 is a top plan view of the device of FIG. 1 without a washing unit.

FIG. 2 shows a cleaning device without the washing unit. The side walls 22 of the device are provided each with a bearing shell 23 and a mounting 24 and are connected with walls 32, 33 (FIG. 3) of the printing press by means of bolts 26. The above mentioned cutting device 10, a spraying hopper 29 with spraying tubes 25, a cutting or terminal strip 31, a washing material-container 34 and the transporting roller 8 are all positioned between the side walls 22. The transporting roller 8 has axial extensions by means of which as clearly shown in FIG. 3, this roller is rigidly secured to respective inner rings of two opposite direction-of-rotation-switching couplings 27 and 28. The outer ring of the direction-of-rotation switching coupling 28 is rigidly connected to the wall 32 of the printing press whereas the outer ring of the direction-of-rotation switching coupling 27 is connected via a crank 36 and a link or joint 37 with a work cylinder 35 which is hinged in the wall 33 of the printing press and is pivotally supported in and operatively connected to the side wall 32. A gear 38 is rigidly secured to one axial extension of the transporting roller 8, this gear being rigidly connected (when the washing unit is inserted in the cleaning device) with the axle of the counter pressure roller 9 and is in cooperation with a counter gear not shown herein.

The mode of operation of the cleaning device of this invention is as follows:

After the washing unit has been provided with the supply roll 1 outside the printing machine (FIG. 5) this unit is inserted with its bearing pins 19 into bearing shells 23 of the side walls 22, then it is pivoted about these pins to the position immediately against the cylinder 6 and is locked in this position by levers 20 and by means of the non-illustrated but any suitable conventional locking device and the mounting 24. Thereby the counter gear rigidly mounted to the axle of the counter pressure roller 9 is automatically brought into engagement with the gear 38 so that the washing material 2 is pressed by the spring-biased pressure roller 9 against the transporting roller 8 and the connection to the pressure medium feeding is established. Furthermore, the connection between the scanning device 5 and an end switch is also extablished automatically so that the control is possible via the washing material supply on the supply roll 1.

During the washing process the washing liquid or water is sprayed from the spraying tubes 25 onto the upper surface of the printing cylinder 6. Thereafter or simultaneously therewith the hollow member 7 is periodically filled with a pressure medium and thereby brings the washing cloth or material 2 in contact with the upper surface of the cylinder 6. The washing material 2 is rolled from the supply roll 1 in accordance with a contamination degree of the printing cylinder 6 in respective intervals and is fed to the hollow member 7 and further between the counter pressure roller 9 and transporting roller 8, which is driven in the transport direction by the work cylinder 35. After the completion of the cleaning process the circular blade 30 is fed by the non-shown but any suitable conventional means along the strip 31 so that the contaminated portion of the washing cloth is cut off. Then the separated washing cloth which falls into the container 34 is removed from the latter.

After the washing material of the supply roll 1 is used up the washing unit is removed from the side walls 22 and a new supply roll is installed into the unit, which roll is held by the shaft butts 11 and 12. The brake positioned on the shaft butt 11 is adjusted so that the washing material 2 is continually transported without any problems. The supply roll 1 is axially fixed on the shaft butt 12 by the locking device 13 of any suitable design.

In order to ensure a better access to the cylinder 6 the side walls 22 can be pivoted away about an axis parallel to the cylinder 6, this axis being formed by the two opposite bolts 26.

The control of the whole device is obtained by a non-shown but any suitable conventional means. The succession of individual operation steps, their timing and adjustment as well as their number can be defined by various programs which can be selected in accordance with operation requirements.

It will be understood that each of the elements described above, or two or more together, may also find a useful application in other types of devices for cleaning cylinders of a printing machine differing from the types described above.

While the invention has been illustrated and described as embodied in a device for cleaning cylinders of a printing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for cleaning a cylinder of a printing machine with a washing cloth, comprising a supply roll for the washing cloth; pressing means for pressing the washing cloth against the printing cylinder; a transporting roller and a counter pressure roller for pulling the washing cloth from said supply roll to said pressing means; opposite side walls rigidly supported in the printing machine and supporting said transporting roller; opposite plates, scanning means on said supply roll for controlling the amount of washing cloth on said supply roll in operation; an elastic hollow member loaded with pressure medium and operating as said pressing means; means for cutting a portion of the washing cloth passing the printing cylinder; and means for spraying washing fluid onto the printing cylinder; said supply roller, said scanning means, said elastic hollow member and said counter pressure roller being assembled in said plates into a functional unit and said plates are arranged in said side walls so that said functional unit is removable from, pivotable in and lockable in said side walls, said plates further supporting said scanning means and said spraying means.

2. The device as defined in claim 1, wherein said side walls are pivotable about an axis parallel to the printing cylinder.

3. The device as defined in claim 1; further including a washing cloth-receiving container positioned below said cutting means.

4. The device as defined in claim 1, wherein a pressure medium feeding means is provided and, upon the pivoting of said unit, said pressure medium feeding means and said counter pressure roller and said transporting roller being automatically coupled with the washing cloth transported therebetween.

* * * * *